United States Patent [19]

Caldwell

[11] 4,156,466

[45] May 29, 1979

[54] AUTOMATIC GRADE AND SLOPE CONTROL APPARATUS

[75] Inventor: Robert H. Caldwell, Jacksonville, Ill.

[73] Assignee: Grizzly Corporation, Jacksonville, Ill.

[21] Appl. No.: 870,873

[22] Filed: Jan. 20, 1978

[51] Int. Cl.[2] ..... E02F 3/76

[52] U.S. Cl. ..... 172/4.5; 172/794

[58] Field of Search ..... 172/4, 4.5, 387, 392, 172/393, 665, 727, 728, 729, 794; 37/DIG. 1, DIG. 20; 214/762, 763; 404/84

[56] References Cited

U.S. PATENT DOCUMENTS

| | | | |
|---|---|---|---|
| 3,022,060 | 2/1962 | Cook et al. | 172/794 X |
| 3,519,770 | 7/1970 | Long et al. | 404/84 X |
| 3,552,498 | 1/1971 | Stauber | 172/794 X |
| 3,786,871 | 1/1974 | Long et al. | 172/4.5 |

FOREIGN PATENT DOCUMENTS

| | | | |
|---|---|---|---|
| 40639 | 8/1929 | Denmark | 172/387 |
| 1362275 | 4/1964 | France | 172/4 |

*Primary Examiner*—Richard T. Stouffer

[57] ABSTRACT

An apparatus mounting on the main frame of a motor-grader for controlling grading and sloping of road shoulders and previously subgraded surfaces having a resilient suspension system for the moldboard depending from the main frame of the grader which is laterally spaced from the point of application of a control load by a universally-connected, double-acting hydraulic jack attached thereto; said moldboard being lifted against said resilient support relative to the main frame of the grader for grade control by a shoe, wheel or ski, which is mounted adjacent the one end thereof and arranged for sliding along a roadway or other previously graded surface as a horizontal reference, and tilted relative to the main frame for slope control by manipulation of the double-acting hydraulic jack controlled by a feedback controller which measures the error in actual moldboard tilt and compares it to a fixed vertical reference as determined by a pendulous sensor and corrects the same in establishing the desired slope to the road shoulder or subgraded surface relative to the vertical by proper manipulation of the double-acting hydraulic jack.

9 Claims, 5 Drawing Figures

AUTOMATIC GRADE AND SLOPE CONTROL APPARATUS

BACKGROUND OF THE INVENTION

In the past, much time and effort has been expended in preparation for grading and sloping of highway shoulders wherein stakes have been set and guidewires strung for establishing reference planes to guide manual or automatic controllers in grading and sloping to ⅛ inch in 10 feet.

U.S. Pat. No. 3,750,756 to Livingston discloses a mechanical means for attachment to the moldboard of a roadgrader which automatically controls both slope and grade.

SUMMARY OF THE INVENTION

The gist of this invention lies in an apparatus for operational connection to the moldboard or blade of a roadgrader which utilizes the right hand edge of a hard-top roadway or tire track left by the right hand wheel of the bolster axle of the same for establishing vertical and fixed elevation planes of reference for road shoulder and other sub-grading purposes. Said apparatus, in combination with a feedback controller including a fixed vertical reference means, comprises a roadgrader having resilient lifting link universally-connected to the left end of the blade support structure which is laterally spaced relative to the main frame of the grader from the point of application of a control load by a double-acting hydraulic jack universally-connected to the right end of the same. Said blade has vertical degree of freedom for grade control relative to a fixed elevation plane of reference established by a shoe, wheel or ski, which is universally-swivelled adjacent to the left end of said blade, and slides as the motorgrader moves in forward relation to the shoulder of the road or previously graded surface. Said blade has lateral degree of freedom for slope control relative to a vertical plane of reference established by the operator of the roadgrader, as he steers the outside sidewall of the tire on the left hand wheel of the roadgrader bolster axle along the right side of the hard-top edge of the road or the right hand tire track from the previous grading operation. Said blade has tilt degree of freedom for slope control relative to the vertical established by a feedback controller means which measures the error in actual blade tilt against a desired slope of the shoulder of the road or previously graded surface as indicated relative to a set vertical reference means and corrects the same by proper manipulation of the double-acting jack in a hydraulic system having a directional flow control valve which is operationally connected to and in fluid communication with said controller and said hydraulic jack, respectively.

THE PREFERRED EMBODIMENT

Figure 1:
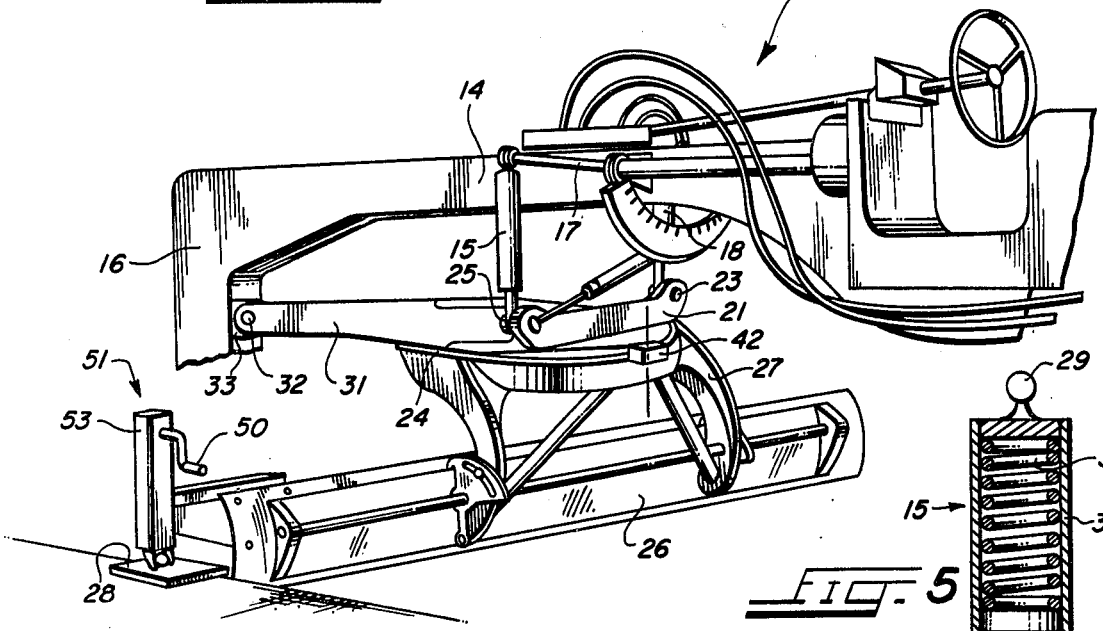
FIG. 1 is an isometric illustration of a motorgrader equipped to employ the present invention.
Figure 2:
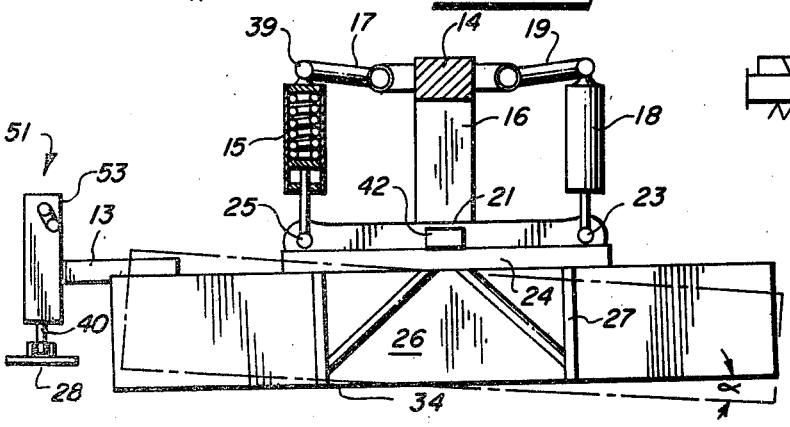
FIG. 2 is a view looking forward at the midsection of the frame of the grader showing the lift link for grade control and the hydraulic jack for tilt control.
Figure 2:
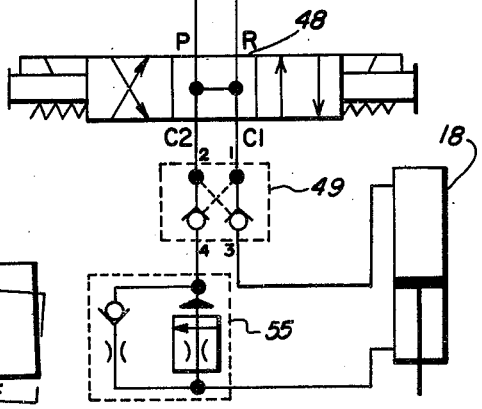

Referring to FIG. 1, a motorgrader 10 includes a forwardly-extending main frame 14 which is integrally-associated with a bolster (not shown) which is the forwardly-most portion of the grader. Disposed on the right hand side of main frame 14 is a single-ended, double-acting hydraulic lift jack 18, as shown in FIG. 2. The cylinder end of the jack 18 is pivotally-secured to the end of right hand lifting crank 19 of the motorgrader 10 which in turn is pivotally mounted on the right side of main frame 14 at the midsection thereof. The rod end of jack 18 is secured to the right end of a crossbar 21 through a first ball and socket joint 23. Disposed on the left hand side of the main frame 14 is a constant-force lift link 15. The top end of the lift link 15 is pivotally secured to the end of left hand lifting crank 17 which in turn is pivotally mounted in the left side of main frame 14 at the midsection thereof. The bottom end of arm 15 is secured to the left end of the crossbar 21 through a second ball and socket joint 25. Crossbar 21 is disposed transversely of the longitudinal axis of the motorgrader 10 and carries a blade support circle 24 to which the motorgrader blade 26 is secured by a connecting member 27. The member 27 is associated with the blade support circle 24 in a manner which enables the support member 27 to be positioned any desired angle (within limits) by a drive system including drive rods and a drive gear (not shown).

A drawbar 31 is disposed between the blade support circle 24 and the bolster 16. The drawbar is rigidly connected to the blade support circle 24 at one of its ends and connected at its other end to the bolster 16 by an articulate connection formed by a ball 32 integral with drawbar 31 and a socket 33 formed integrally with the bolster 16. A bolster axle (not shown) mounts transversely to the longitudinal axis of the grader 10 on bolster 16. Right hand and left hand tires (not shown) each mount on right and left wheels (not shown), respectively, at opposite ends of the bolster axle.

Figure 5:
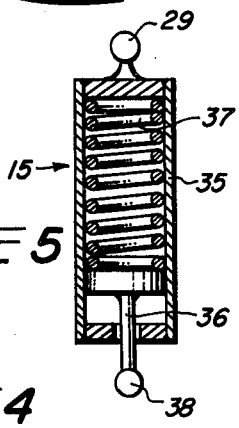
FIG. 5 is a cross-section of the resilient lift link of FIG. 2.

The lift link 5, as shown in FIG. 5, comprises a tubular member 35 which is connected at its closed upper end through a ball 29 to ball and socket joint 39 on lift crank 17 and depends with a plunger end facing downwardly therefrom, as shown in FIG. 2. A plunger member 36 slidingly inserts in the lower end of said member 35 and connects at its lower end through a bottom ball 38 to ball and socket joint 25 on crossbar 21. A compression spring 37 slidingly inserts in the tubular member 35 between the closed upper end thereof and the enlarged upper end of said plunger member 36 within said tubular member 35.

Figure 3:
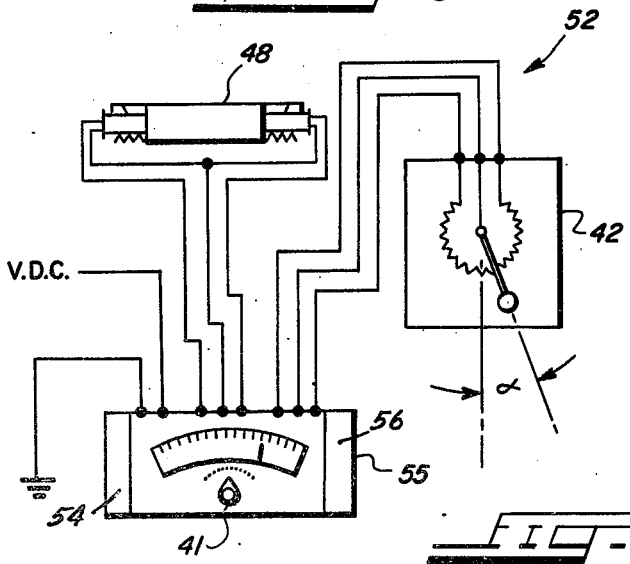
FIG. 3 is a schematic of a tilt controller for blade tilt control.

The tilt of the blade 26 is defined as the angle $\alpha$ which the cutting edge 34 of the blade makes with the horizontal plane, as shown in FIG. 2. The blade support member 27, circle 24 and drawbar 31 as a single structure has two degrees of freedom of movement relative to frame 14, one giving lateral tilt of the blade 26 and the other giving lift of the same. Operation of the hydraulic jack 18 for a set lift of lift link 15 causes relative displacement between the vertical positions of ball and socket joints 23 and 25, as shown in FIG. 2, and changes the tilt of the blade 26. Coordinated lifting or lowering of the rod end of jack 18 and the bottom end of lift link 15 together changes the lift of the blade circle 24 and the grade of blade 26. These two degrees of freedom of the blade support structure 27 relative to the frame 14, as supplied by jack 18 and link 15 in operation on support member 27 and blade circle 24, enables both the lift and the tilt of blade 26 to be simultaneously and independently controlled by grade control system 51 and a tilt control system 52, as shown in FIGS. 2 and 3.

The grade control system 51 comprises a screw jack 53 mounted on the end of bracket 13 which extends from the left end of blade 26, as shown in FIG. 2. An adjustable plunger 40 which is operated by handcrank 50 with graduated scale index for predetermining grade depends from the bottom of said screw jack 53. A shoe 28 universally mounts on the lower end of said plunger 40 for sensing the previously graded surface and controlling the vertical lift of blade 26 to a predetermined grade relative to that surface.

Figure 4:
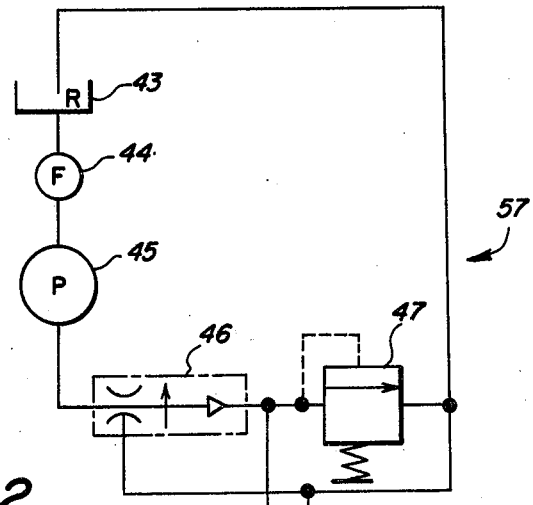
FIG. 4 is a schematic of the hydraulic system for manipulating blade tilt.

The tilt control system 52 comprises a pendulous slope sensor 42 which responds to the direction of gravity and mounts on the blade circle 24, as shown in FIGS. 1 and 2, for controlling the tilt of blade 26 relative to the vertical. An open-center hydraulic system 57, as shown in FIG. 4, mounts on the frame 14 in operational connection with the pendulous slope sensor 42, and comprises a reservoir 43, a filter 44 in fluid communication with the outlet therefrom, a fixed displacement pump 45 having its inlet in fluid communication with the outlet of pump 45 and a fixed flow control valve 46 in fluid communication with the reservoir 43 for manipulating and controlling the tilt of the blade 26 to a predetermined slope relative to the lift of the same as established by the grade control system 51. A pressure relief valve 47 which is set to system hydraulic operating pressure connects its inlet in fluid communication with the outlet from flow control valve 46 and its outlet in fluid communication with reservoir 43. A four-way, three-position, open-center, solenoid-operated, directional flow-control valve 48 has its P port connected in fluid communication with the outlet from flow fixed control valve 46 and its R port in fluid communication with the reservoir 43. A lock valve 49 has one valve port in fluid communication with the No. 2 cylinder port of the directional control valve 48 and its other valve port in fluid communication with the No. 1 cylinder port of said valve 48. One cylinder port of valve 49 fluid communicates with the head end of hydraulic jack 18 and the other cylinder port of the same fluid communicates with the rod end of said jack 18 through a fixed flow control valve 50.

A feedback controller means 55 having a comparator means 54 for determining the error between the predetermined tilt relative to the vertical and the actual tilt of the moldboard or blade 26 and an inverting means 56 for producing a feedback signal in proportion to and out of phase with said error in the manner of controls readily-available on the market such as the slope sensor and the relay transmission unit of the AP-6000 Series Automatic Slope Control System manufactured by Burgin Grade Control, Inc., P.O. Box 635, Poplar Bluff, Missouri, 63901, mounts on the frame 14, as shown in FIG. 3, and operationally connects a V. D.C. power supply to the electrical input terminals of the directional flow-control valve 48 and the pendulous slope sensor 42. An adjustable knob 41 with graduated scale index for predetermining slope mounts on and is in operational connection with controller 55 for establishing the error in tilt of blade 26 as compared to the predetermined slope as set by knob 41 and correcting the same.

Although but one specific embodiment of this invention is herein shown and described, it will be understood that details of the construction shown may be altered or omitted without departing from the spirit of the invention as defined by the following claims.

I claim:

1. In a motorgrader having a moldboard and a main frame comprising:
   (a) a moldboard lift manipulative means operationally mounted on the moldboard adjacent to one end thereof on one side of said main frame for sensing a predetermined grade and correctively lifting said moldboard to said grade;
   (b) a resilient lift link means universally mounted at its top end to the manual moldboard tilt and lift mechanism on the one side of the main frame and at its bottom end to the moldboard on the same side thereof;
   (c) a moldboard tilt manipulative means universally mounted at its top end to the manual moldboard tilt and lift mechanism on the other side of said main frame and at its bottom end to the moldboard on the other side of said main frame;
   (d) a vertical reference means operationally mounted on said moldboard; and
   (e) a moldboard tilt controller means mounted on said frame operationally connected to said vertical reference means and to the moldboard tilt manipulative means for correctively tilting said moldboard to a predetermined tilt relative to the vertical.

2. In a motorgrader, as set forth in claim 1, wherein the resilient lift link means comprises:
   (a) a tubular member having an open lower end of stepped-down I.D. and a closed upper end connected to a universal mount at the top end of said link means;
   (b) a plunger member having a lower end connected to a universal mount at the bottom end of said link means and slidingly inserting in the stepped-down I.D. of said tubular member, and having its upper end slidingly inserting in the I.D. of said tubular member; and
   (c) a compression spring slidingly inserted in the I.D. of said tubular member between the closed upper end of said tubular member and the upper end of said plunger member.

3. In a motorgrader, as set forth in claim 1, wherein the moldboard lift manipulative means comprises:
   (a) a mechanical jack having a vertically-adjustable plunger depending therefrom;
   (b) a shoe universally-mounted on the bottom end of said plunger.

4. In a motorgrader, as set forth in claim 1, wherein the moldboard tilt manipulative means comprises:
   (a) a double-acting hydraulic jack having a rod end and a cylinder end; and
   (b) an open-center hydraulic circuit in fluid communication with said jack.

5. In a motorgrader, as set forth in claim 1, wherein the vertical reference means comprises a pendulous slope sensor.

6. In a motorgrader, as set forth in claim 1, wherein the moldboard tilt controller means comprises:
   (a) a comparator means for determining the error between the predetermined tilt relative to the vertical and an actual tilt of the moldboard; and
   (b) an inverter means for producing a feedback signal in proportion to and out of phase with said error.

7. An apparatus for automatic grade and slope control comprising a motorgrader having a forwardly-extending main frame, a crossbar disposed transversely of the longitudinal axis of the motorgrader, a motorgrader moldboard support circle depending from said crossbar, a drawbar rigidly connected to the moldboard support circle extending forwardly therefrom and including universal coupling means between the forward end thereof and the forward end of the main frame, bolster means having an axle with wheels and tires mounted at each end steerably-mounted on the forward end of the main frame, a moldboard support member depending from said circle, and a moldboard depending from said support member, the improvement in suspension of said crossbar from said main frame comprising:

(a) a constant-force resilient lift link means universally-connected at its top end to the one side of said main frame and at its bottom end to the end of said crossbar on the same side of said main frame;

(b) an elevation sensing means mounted on the moldboard adjacent to the end thereof on the same side of said main frame as said constant-force lift link means;

(c) a double-acting hydraulic jack universally connected at its top end to the other side of said main frame and at its bottom end to the other end of said crossbar;

(d) a vertical reference means operationally mounted on said moldboard; and (e) an automatic controller means operationally connected to said vertical reference means and to each end of said double-acting hydraulic jack.

8. An apparatus for automatic grade and slope control, as set forth in claim 7, wherein the constant-force resilient lift link means comprises:

(a) a tubular member having an open lower end and a closed upper end adjacent and connected to the top end of said link means;

(b) a plunger member having a lower end adjacent and connected to the bottom end of said link means and slidingly inserting its upper end in the open lower end of said tubular member; and (c) a compression spring slidingly inserted in said tubular member between said closed upper end of said tubular member and said upper end of said plunger member.

9. An apparatus for automatic grade and slope control, as set forth in claim 7, wherein the elevation sensing means comprises:

(a) a mechanical jack having an adjustable extensible plunger; and (b) a shoe universally swivel-mounted on the end of said plunger.

* * * * *